US010100563B2

(12) United States Patent
Murray et al.

(10) Patent No.: US 10,100,563 B2
(45) Date of Patent: Oct. 16, 2018

(54) MULTIPLE PIECE CONSTRUCTION AUTOMOTIVE DOOR HINGE

(71) Applicant: MULTIMATIC INC., Markham (CA)

(72) Inventors: Robert John Murray, Uxbridge (CA); Rudolf Gruber, Uxbridge (CA); Chean Wang Ng, Newmarket (CA); Pasith Banjongpanith, Stouffville (CA); Prad Lad, Unionville (CA); Scott Worden, Keswick (CA)

(73) Assignee: MULTIMATIC INC., Markham, Ontario (CA)

( * ) Notice: Subject to any disclaimer, the term of this patent is extended or adjusted under 35 U.S.C. 154(b) by 0 days.

(21) Appl. No.: 15/825,427

(22) Filed: Nov. 29, 2017

(65) Prior Publication Data

US 2018/0100337 A1 Apr. 12, 2018

Related U.S. Application Data

(63) Continuation of application No. 12/091,384, filed as application No. PCT/CA2007/000199 on Feb. 12, 2007, now Pat. No. 9,863,175.

(30) Foreign Application Priority Data

Jul. 10, 2006 (CA) ..... 2551642

(51) Int. Cl.
*E05D 9/00* (2006.01)
*E05D 5/06* (2006.01)
(Continued)

(52) U.S. Cl.
CPC ..... *E05D 9/00* (2013.01); *E05D 3/02* (2013.01); *E05D 5/0207* (2013.01); *E05D 5/062* (2013.01);
(Continued)

(58) Field of Classification Search
CPC .. E05D 9/00; E05D 5/062; E05D 5/12; E05D 5/127; E05D 11/06; E05Y 2600/506; Y10T 16/557
See application file for complete search history.

(56) References Cited

U.S. PATENT DOCUMENTS 1,164,857 A 12/1915 Parsons
1,582,701 A * 4/1926 Soss ..... E05D 3/02 16/389
(Continued)

FOREIGN PATENT DOCUMENTS

EP 1398440 A2 3/2004
EP 1574650 A2 9/2005
(Continued)

OTHER PUBLICATIONS

European Patent Application No. 14159033.1, Extended European Search Report dated Apr. 26, 2016, 9 pgs.
(Continued)

*Primary Examiner* — Victor D Batson
*Assistant Examiner* — Matthew J Sullivan
(74) *Attorney, Agent, or Firm* — Fredrickson & Byron, P.A.

(57) ABSTRACT

An automotive hinge assembly adapted to facilitate motion of a closure panel relative to a fixed body structure comprises a door component constructed from two press formed angle brackets structurally connected via a pivot pin and adapted to be mounted to a vehicle closure panel, a body component constructed from two press formed angle brackets structurally connected via a simple formed feature and the pivot pin and adapted to be mounted to a vehicle body structure, such that the pivot pin structurally assembles the two hinge components, facilitates relative rotary motion between them and structurally connects the multiple press formed angle brackets so that the resulting assembly
(Continued)

achieves a much higher material efficiency than the prior art with an associated significant cost reduction.

21 Claims, 9 Drawing Sheets

(51) Int. Cl.

| | |
|---|---|
| ***E05D 5/12*** | (2006.01) |
| ***E05D 11/06*** | (2006.01) |
| ***E05D 3/02*** | (2006.01) |
| ***E05D 5/02*** | (2006.01) |

(52) U.S. Cl.
CPC ..... *E05D 5/12* (2013.01); *E05D 5/127* (2013.01); *E05D 11/06* (2013.01); *E05Y 2600/506* (2013.01); *E05Y 2900/531* (2013.01); *Y10T 16/557* (2015.01)

(56) References Cited

U.S. PATENT DOCUMENTS

| | | | | |
|---|---|---|---|---|
| 1,941,348 | A | 12/1933 | Hathorn | |
| 2,200,317 | A * | 5/1940 | Wintercorn | E05D 7/06 16/224 |
| 2,585,836 | A * | 2/1952 | Quigley | E05D 3/02 16/250 |
| 4,675,940 | A * | 6/1987 | Brockhaus | E05D 5/127 16/254 |
| 5,092,017 | A | 3/1992 | Hatano et al. | |
| 5,577,295 | A | 11/1996 | Papke et al. | |
| 5,590,441 | A | 1/1997 | Spencer | |
| 5,682,646 | A | 11/1997 | Tyler et al. | |
| 5,987,703 | A | 11/1999 | Kluting et al. | |
| 6,427,287 | B1 | 8/2002 | Brueckner et al. | |
| 6,453,510 | B1 | 9/2002 | Cummins et al. | |
| 6,591,451 | B2 | 7/2003 | Gruber et al. | |
| 6,718,596 | B2 | 4/2004 | Kohlstrand et al. | |
| 6,922,872 | B2 | 8/2005 | Gruber | |
| 7,581,793 | B2 * | 9/2009 | Hartmann | B60N 2/3013 296/65.03 |
| 9,863,175 | B2 * | 1/2018 | Murray | E05D 9/00 |
| 2005/0210630 | A1 | 9/2005 | Lowen et al. | |

FOREIGN PATENT DOCUMENTS

| | | | |
|---|---|---|---|
| GB | 2077348 | A | 12/1981 |
| GB | 2099070 | A | 12/1982 |
| JP | S51-37359 | A | 3/1976 |
| JP | S52-49432 | A | 4/1977 |
| JP | S57-1259 | A | 1/1982 |
| JP | S63-156183 | A | 6/1988 |
| JP | 01071981 | A | 3/1989 |
| JP | 4-39266 | A | 4/1992 |
| JP | H05113069 | A | 5/1993 |
| JP | H11101048 | A | 4/1999 |
| JP | 11166345 | A | 6/1999 |
| JP | 2000192717 | A | 7/2000 |
| JP | 2002522670 | A | 7/2002 |
| JP | 2004257057 | A | 9/2004 |
| WO | 2000037759 | A1 | 6/2000 |

OTHER PUBLICATIONS

Japanese Office Action for corresponding application P2009-518690 dated Aug. 9, 2011, 3 pgs.
Japanese Office Action for corresponding application P2009-518690 dated Jul. 10, 2012, 3 pgs.

* cited by examiner

FIG. 6.
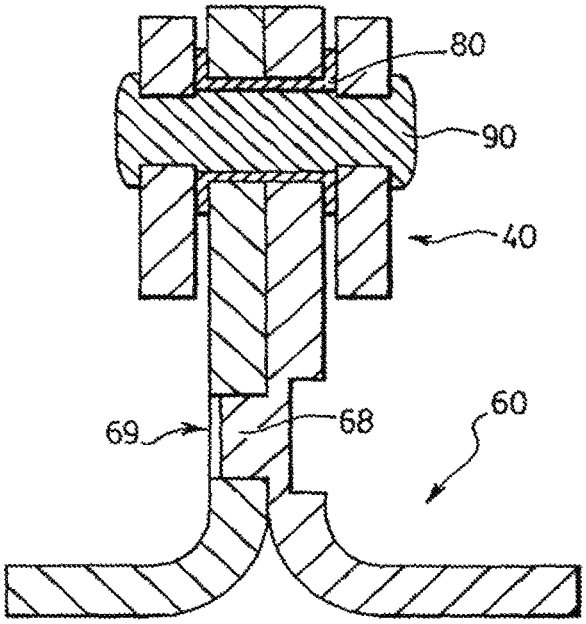
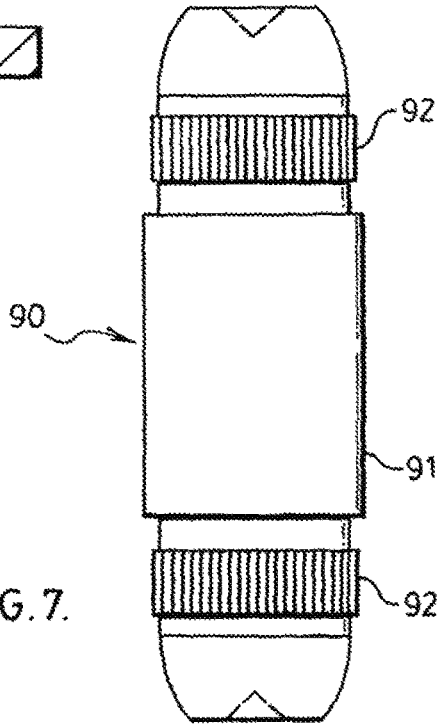
FIG. 7.

MULTIPLE PIECE CONSTRUCTION AUTOMOTIVE DOOR HINGE

RELATED APPLICATIONS

This application is a continuation of U.S. patent application Ser. No. 12/091,384, filed Apr. 24, 2008, which is a US 371 national stage entry of International Application No. PCT/CA2007/000199, filed Feb. 12, 2007, which claims priority to Canadian Application No. 2551642, filed Jul. 10, 2006, the teachings of each which are incorporated herein by reference.

FIELD OF THE INVENTION

This invention applies to hinges, more particularly to automotive hinges, which facilitate motion of a closure panel relative to a fixed body structure, and simplify the configuration of the constitutive hinge components using a unique multiple piece construction.

BACKGROUND TO THE INVENTION

Automotive hinges are generally configured to include a door component that is rigidly attached to a closure panel and a body component that is rigidly attached to a body structure. This structural attachment of the components can be achieved by welding, riveting, bolting or similar mechanical fastening means. The simple rotary motion of the door component relative to the body component is normally achieved by a pivot pin and associated bearing surfaces. The pivot pin is configured to be rigidly attached to one of the hinge components while the other component freely rotates around the pivot pin via one or more bearing surfaces. It is normal practice to utilize two of these hinge assemblies, vertically offset with coaxially aligned pivot pins, to attach a closure panel to a body structure.

The body and door components of an automotive hinge are commonly constructed from either steel or aluminum using stamping, forging, casting, roll forming or extruding. Each component is generally configured with one or more mounting surfaces and a pair of pivot arms that contain pivot axis holes. The pivot arms are structurally connected by some form of bridge or by the mounting surface. It is common practice to create the required pivot bearing surface by assembling bushings into the pivot axis holes of the door component. A pivot pin is inserted through the pivot bushings of the door component and structurally attached to the body component through the pivot axis holes using knurling, interference fits, riveting, staking or similar means of material upsetting.

The body component is structurally attached to a vehicle body structure via its mounting surface using bolting, welding, bonding, riveting or similar fastening means. The door component is similarly structurally attached to a vehicle closure panel via its mounting surface using bolting, welding, bonding, riveting or similar fastening means.

Bolted automotive hinge systems typically utilize a minimum of two fasteners per hinge component. Complex formations are therefore required to provide the necessary pivot axis hole locations, mounting surfaces, structural integrity, fastener locations and clearance offsets in a single piece component. Forgings and casting are well suited to providing these necessarily complex shapes but carry a significant cost penalty in comparison to press formed metal stampings. Metal stamping is generally considered the most cost effective method of creating hinge components but formation shape is somewhat limited. Additionally, complex configurations generally result in large quantities of unused scrap material being produced during the press forming process.

FIG. 1 illustrates a common prior art embodiment of an automotive door hinge assembly (1) configured from a press formed body component (2), a press formed door component (3), a pivot pin (4) and two pivot bushings (25)(26). The body component (2) is configured with a pair of pivot arms (6)(7) and a large mounting surface (8) that is adapted to be structurally attached to a vehicle body structure via mounting holes (9)(10) and two corresponding threaded fasteners. These mounting holes (9)(10) are spaced at an adequate distance to assure sufficient load spreading into the vehicle body structure. The pivot arms (6)(7) are configured with a pair of pivot holes (11)(12) adapted to accept and rigidly capture the pivot pin (4) via knurling, interference fits, riveting, staking or similar means of material upsetting. The distance from the mounting holes (9)(10) to the pivot holes (11)(12) is dictated by the vehicle's closure panel and body configuration and can be substantial. The door component (3) is configured with a pair of pivot arms (13)(14), a structural bridge (21) and a pair of mounting surfaces (15)(16) that are adapted to be structurally attached to a vehicle closure panel via mounting holes (17)(18) and two corresponding threaded fasteners. These mounting holes (17)(18) are spaced at an adequate distance to assure sufficient load spreading into the vehicle closure panel. The pivot arms (13)(14) are configured with a pair of pivot holes (19)(20) adapted to accept the pivot bushings (25)(26) that facilitate rotation around the pivot pin (4). The distance from the mounting holes (17)(18) to the pivot holes (19)(20) is dictated by the vehicle's closure panel and body configuration and can be substantial. Both the body component (2) and door component (3) are press formed from a flat sheet of steel and, due to their complex shapes a significant amount of scrap material is created during the stamping process. FIG. 2 illustrates the flat blank layout of both the prior art body component (2*a*) and the door component (3*a*) as well as the scrap material (22) shown cross hatched associated with the stamping process. Despite the considerable scrap material (22) generated in this configuration, the press formed manufacturing technique is still more cost effective than either casting or forging.

SUMMARY OF THE INVENTION

Accordingly, it would be advantageous to create a hinge assembly that is constructed utilizing press formed metal stampings but which reduces or eliminates the scrap associated with the complex shapes dictated by a vehicle's closure panel and body configuration. A great deal of the material used and scrapped in the press forming of a hinge component is directly attributable to shape complexity dictated by the required distances between the mounting holes and pivot pin support features. It would therefore be a significant improvement over the existing art if the interconnection of these features could be achieved in a more efficient manner.

The present invention is targeted at reducing the total material utilized in press formed metal stamped hinge components by utilizing the pivot pin as a primary structural component. In a conventionally configured automotive door hinge utilizing a single piece door component and single piece body component, the pivot pin performs two primary functions in that it structurally assembles the two components while facilitating relative rotary motion between them. The present invention utilizes the pivot pin for an additional primary function in that it also structurally connects multiple pieces of each individual component. A conventionally manufactured single piece press formed door component normally connects its two mounting surfaces and two pivot arms via an integral structural bridge. The present invention eliminates the structural bridge and configures each mounting surface and associated pivot arm as an individual separate press formed angle bracket and structurally connects two of these angle brackets together using a uniquely configured pivot pin. Additionally, the present invention utilizes a unique body component configured from two simple press formed angle brackets that are structurally connected via a simple formed feature and the pivot pin.

The pivot pin of the present invention is configured with a central cylindrical pivot surface and two knurled opposing cylindrical ends stepped down in diameter from the central cylindrical pivot surface. The two press formed angle brackets of the body component are structurally connected via a simple formed feature on the pivot arms and a single pivot bushing is assembled in the pivot holes via a flanged arrangement. The pivot pin is arranged within the pivot bushing so that the central cylindrical pivot surface can freely rotate and the press formed angle brackets of the door component are configured to be structurally connected to the knurled opposing cylindrical ends of the pivot pin via riveting, staking or similar means of material upsetting.

In an alternative embodiment of the present invention, the opposing cylindrical ends of the pivot pin are configured without knurling and the step between the central cylindrical pivot surface and two opposing cylindrical ends is configured with a slight taper that compensates for the thickness tolerances of the body component during the assembly process. The material interference that creates the structural connection occurs between the tapered step and press formed angle brackets of the door components.

In another alternative embodiment of the present invention, the pivot pin is configured with a cantilevered feature to facilitate simple separation and reassembly of the door and body components as required in some vehicle assembly plants.

In accordance with a principal aspect of the invention, an automotive hinge assembly comprises: (a) a door component constructed from two press formed door angle brackets and adapted to be mounted to a vehicular closure panel; (b) a body component constructed from two press formed body angle brackets, configured to accept a single pivot bushing and adapted to be mounted to a vehicular body structure; (c) a pivot pin configured to structurally connect the press formed door and body angle brackets while holding the door component and body component in structural assembly and facilitating rotary motion between the door component and body component; and (d) the pivot pin being configured with a central cylindrical pivot surface with a central diameter adapted to allow rotation of the pivot bushing thereabout, and 'two knurled opposing cylindrical ends each with a diameter less than the central diameter adapted to structurally connect the door component angle brackets by material upset.

In accordance with further aspects of this invention, an automotive hinge assembly as described, wherein the press formed body angle brackets are structurally joined via a semi-shear feature and matching alignment hole using welding, bonding, riveting, staking or similar means of material upsetting.

In accordance with further aspects of this invention, an automotive hinge assembly as described, wherein a pair of hinge stop formations are provided in the body angle brackets that are adapted to interact with a pair of hinge stop surfaces provided on the door angle brackets so that the hinge assembly is structurally restrained from rotation at its full open position.

In accordance with further aspects of this invention, an automotive hinge assembly as described, wherein the pivot pin incorporates a tapered feature at a stepped interface between the central cylindrical pivot surface and the two knurled opposing cylindrical ends to compensate for thickness tolerances of the body component angle brackets during the assembly process.

In accordance with further aspects of this invention, an automotive hinge assembly as described, wherein the pivot pin is configured to structurally connect the press formed door angle brackets via a pivot bushing, washer and material upset while providing a cantilevered feature to facilitate simple separation and reassembly of the door and body components using a tapered nut and tapered pivot hole arrangement.

In accordance with further aspects of this invention, an automotive hinge assembly as described in the paragraph immediately above, wherein a rivet is adapted to provide the hinge stop on the body component while also structurally joining the press formed body angle brackets.

BRIEF DESCRIPTION OF THE DRAWINGS

FIG. 6 is a partial sectional view of the inventive hinge assembly through the centreline of the pivot pin;

FIG. 7 is a side view of the pivot pin of the inventive hinge assembly;

DETAILED DESCRIPTION OF THE INVENTION

Figure 1:
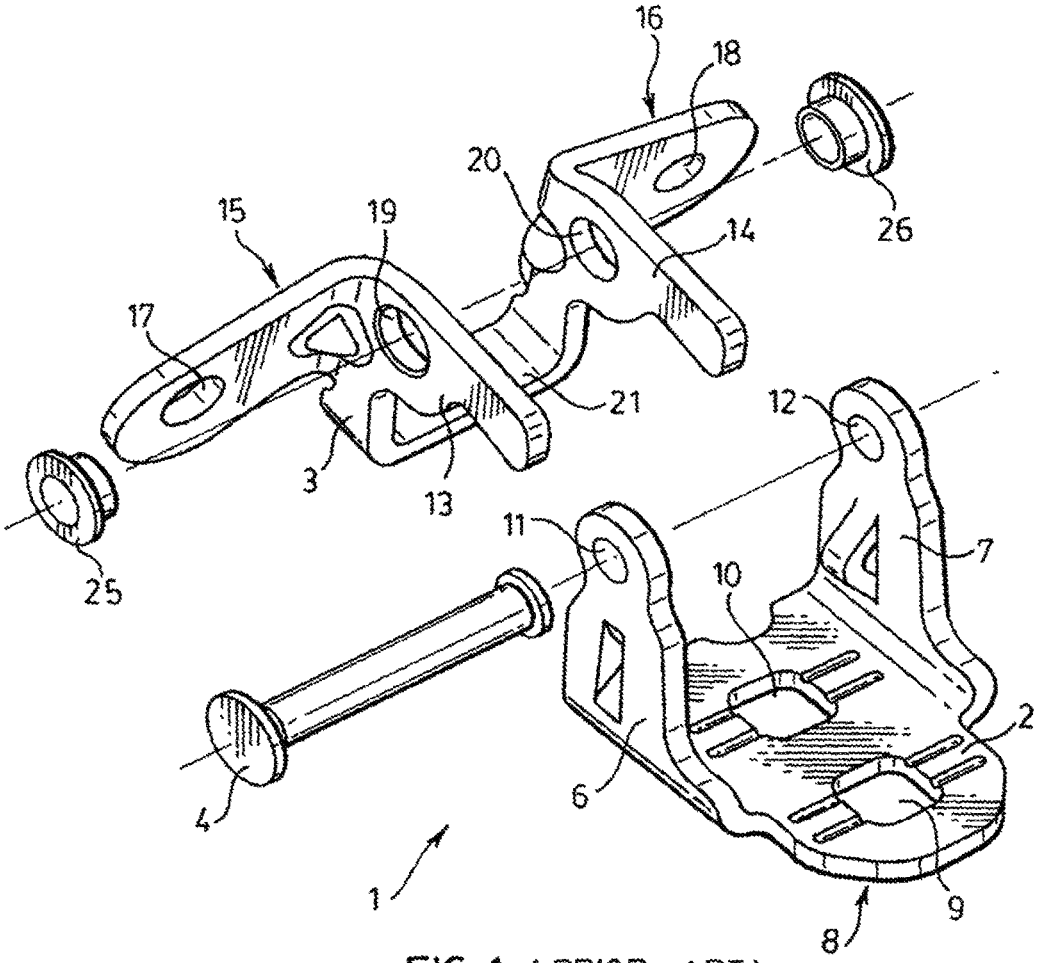
FIG. 1. ( PRIOR ART )
FIG. 1 is an exploded perspective view of a prior art press formed automotive door hinge assembly.

Referring to FIGS. 3, 4, 5 and 6, an automotive hinge assembly (30) is substantially constructed from a door component (40) and a body component (60). The door component is configured with a mounting surface (41) and two pivot arms (42). Each pivot arm (42) contains a pivot axis hole (43). The door component (40) is structurally attached to a vehicle closure panel (27) via its mounting surface (41) using bolting, welding, bonding, riveting or similar fastening means. The body component (60) is configured with a mounting surface (61) and a pivot arm (62). The pivot arm (62) contains a pivot axis hole (63). The body component is structurally attached to a vehicle body structure (28) via its mounting surface (61) using bolting, welding, bonding, riveting or similar fastening means. The pivot axis hole (63) of the body component (60) is fitted with a pivot bushing (80) that contains an internal cylindrical bearing surface (81) and two opposing thrust flanges (82). Referring to FIG. 7, a pivot pin (90) is configured with a central cylindrical pivot surface (91) and two knurled opposing cylindrical ends (92) each with a diameter less than the central cylindrical pivot surface diameter. The central cylindrical pivot surface (91) is adapted to freely rotate within the internal cylindrical bearing surface (81) of the pivot bushing and the two knurled opposing cylindrical ends (92) are adapted to be inserted and structurally connected to the door component (40) pivot axis holes (43) via riveting, staking or similar means of material upsetting. In this way the door component (40) and body component (60) are held in structural assembly but are free to rotate relatively to each other.

Figure 8:
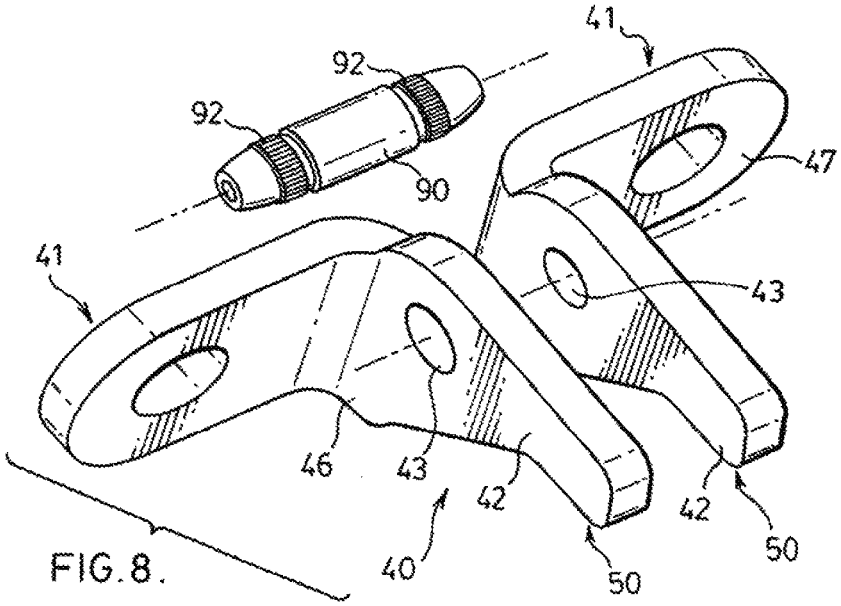
FIG. 8 is an exploded perspective view of the door component of the inventive hinge assembly.

Referring to FIG. 8, the door component (40) is constructed from two press formed door angle brackets (46)(47) that are both configured with a mounting surface (41) and a pivot arm (42). The pivot arms (42) each contain a pivot axis hole (43). When the two knurled opposing cylindrical ends (92) of the pivot pin (90) are pressed into the pivot axis holes (43) and structurally attached via riveting, staking or similar means of material upsetting a single unitary door component (40) is created. The pivot pin (40) therefore replaces the structural bridge normally required to create a single, unitary door component significantly reducing the amount of material required and associated cost.

Figure 9:
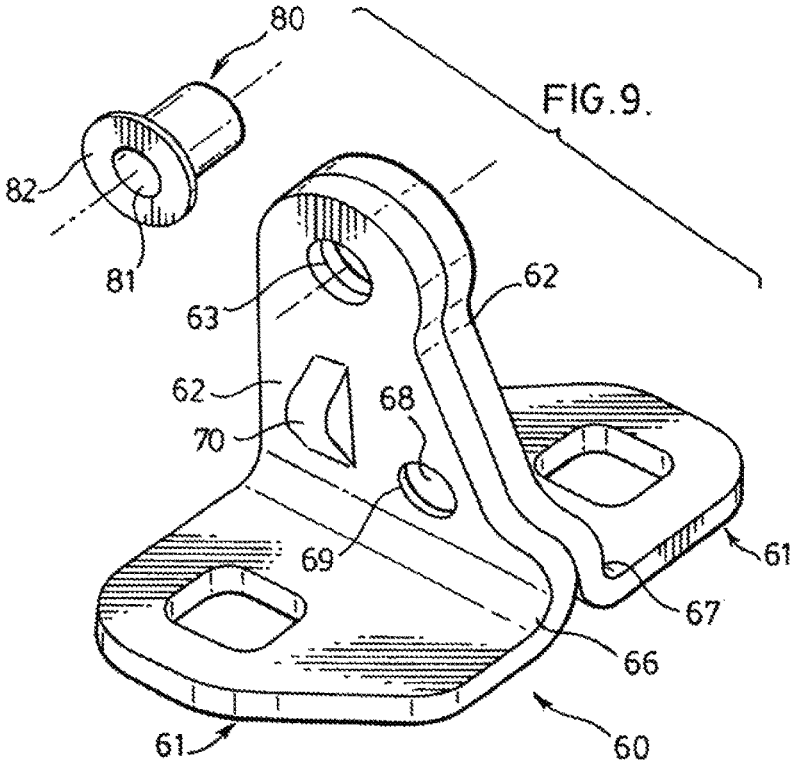
FIG. 9 is an exploded perspective view of the body component of the inventive hinge assembly.

Referring to FIG. 9, the body component (60) is constructed from two press formed body angle brackets (66)(67) that are both configured with a mounting surface (61) and a pivot arm (62). The pivot arms (62) each contain a pivot axis hole (63). The two body angle brackets (66)(67) are configured so that the two pivot arms (62) are arranged surface to surface and aligned via a semi-shear mating feature (68) fitted within a matching alignment hole (69). When the semi-shear mating feature (68) is structurally connected within the alignment hole (69) via press fitting, welding, bonding, riveting, staking or similar means of material upsetting, a single unitary body component (60) is created. The semi-shear mating feature (68) and alignment hole (69) are arranged so that the pivot axis holes (63) are in alignment. The pivot axis hole (63) is fitted with a pivot bushing (80) that contains an internal cylindrical bearing surface (81) and two opposing thrust flanges (82), only one of which is illustrated. In this way the two press formed body angle brackets (66)(67) create a single, unitary body component significantly reducing the amount of material required and associated cost in comparison to a single piece configuration.

Figure 2:
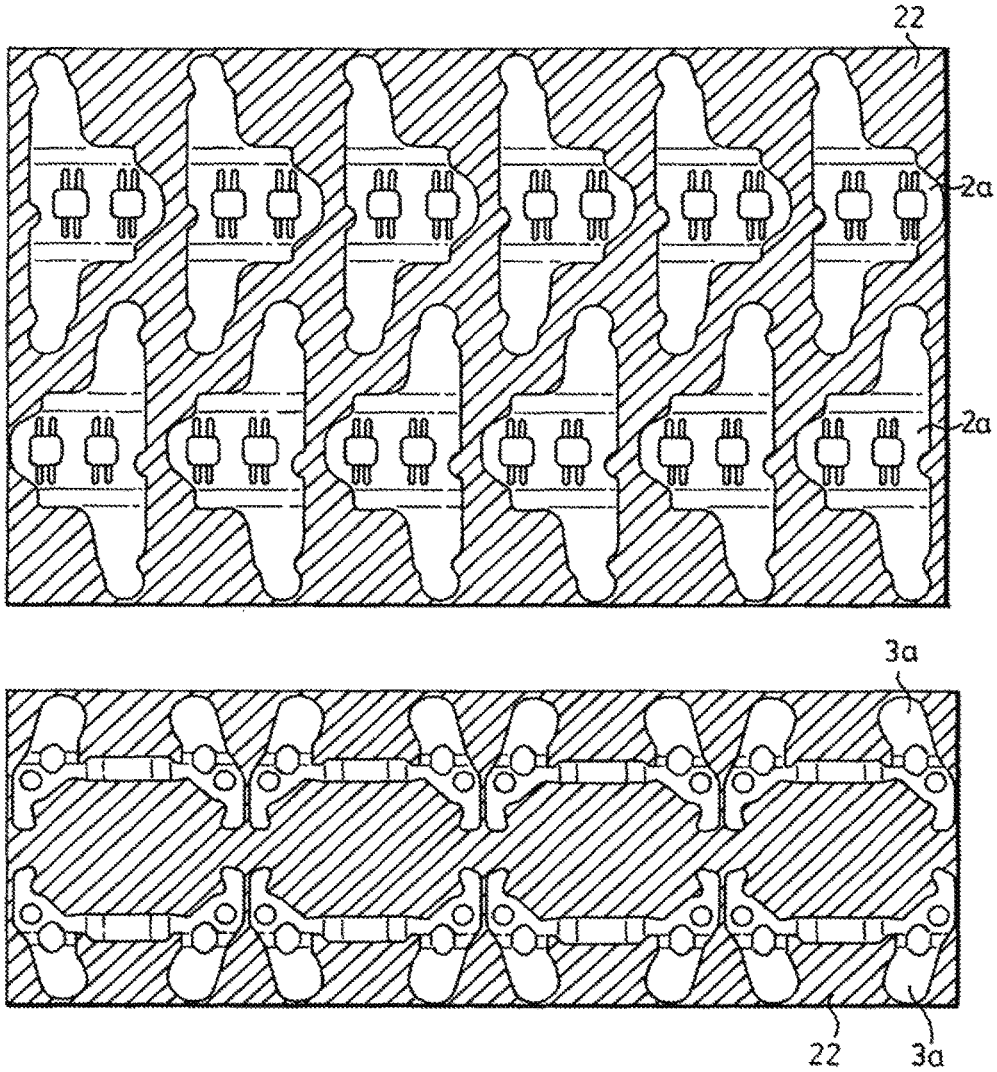
FIG. 2. (PRIOR ART)
FIG. 2 is a plan view of a developed flat blank layout associated with the press form stamping of the components of the prior art automotive door hinge assembly of FIG. 1.
Figure 3:
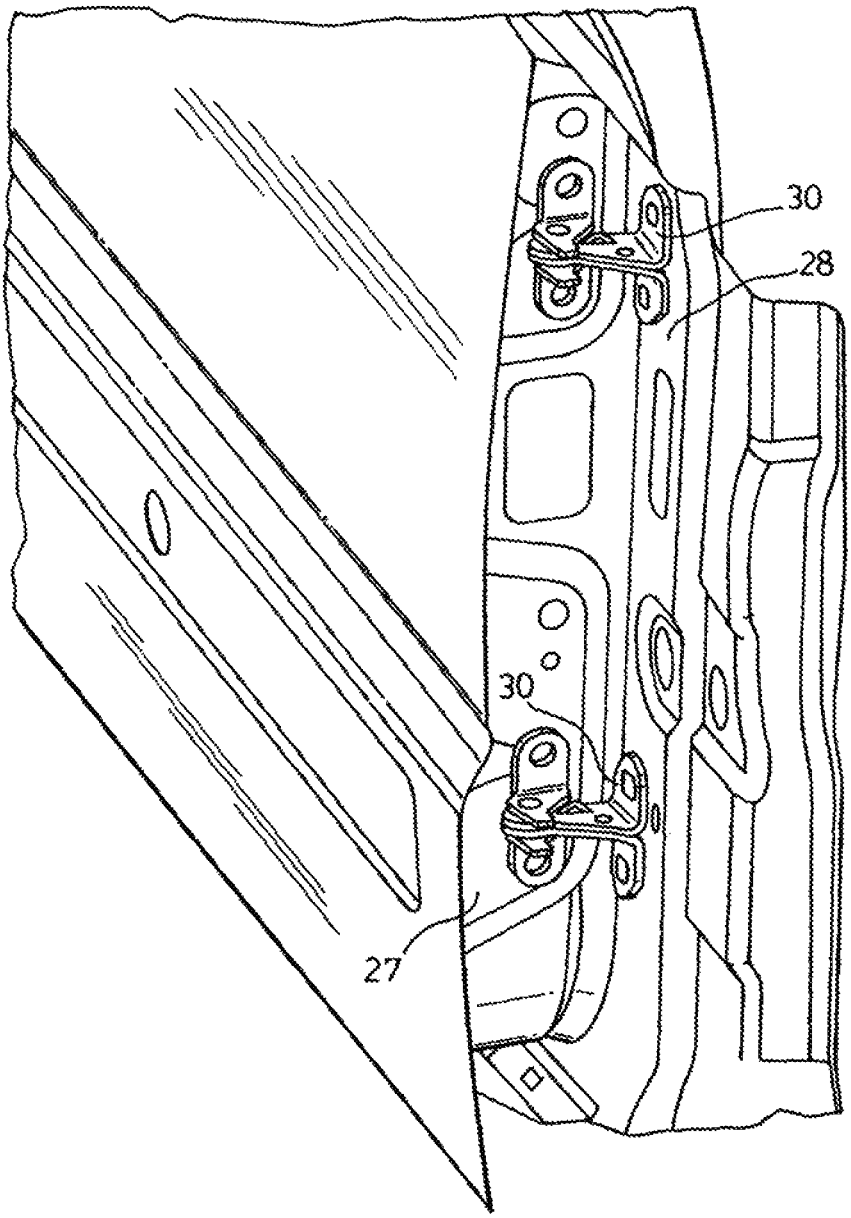
FIG. 3 is a perspective view of a pair of the inventive hinge assemblies in a typical automotive installation.
Figure 4:
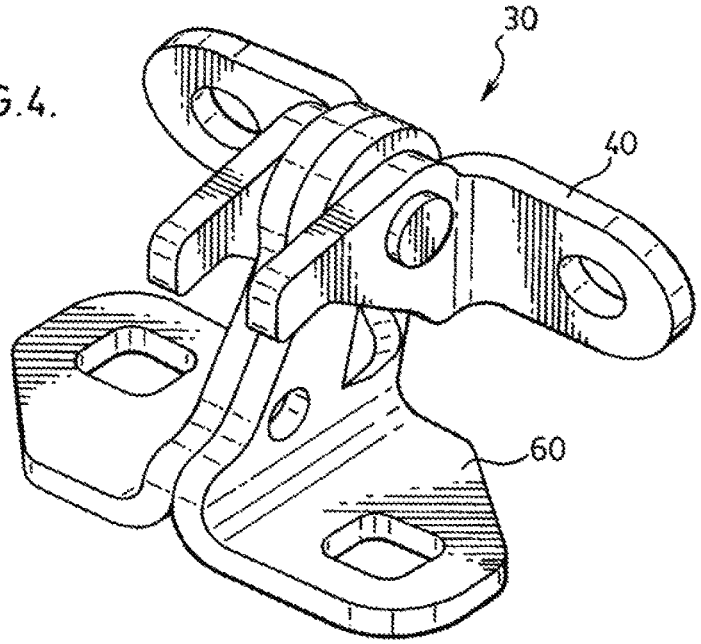
FIG. 4 is a perspective view of the inventive hinge assembly.
Figure 5:
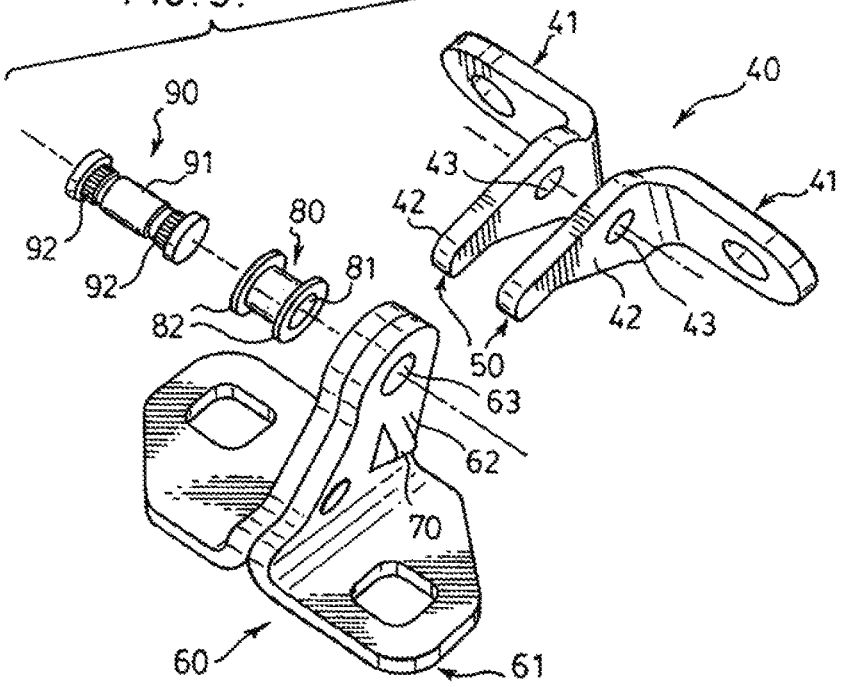
FIG. 5 is an exploded perspective view of the inventive hinge assembly.
Figure 10:
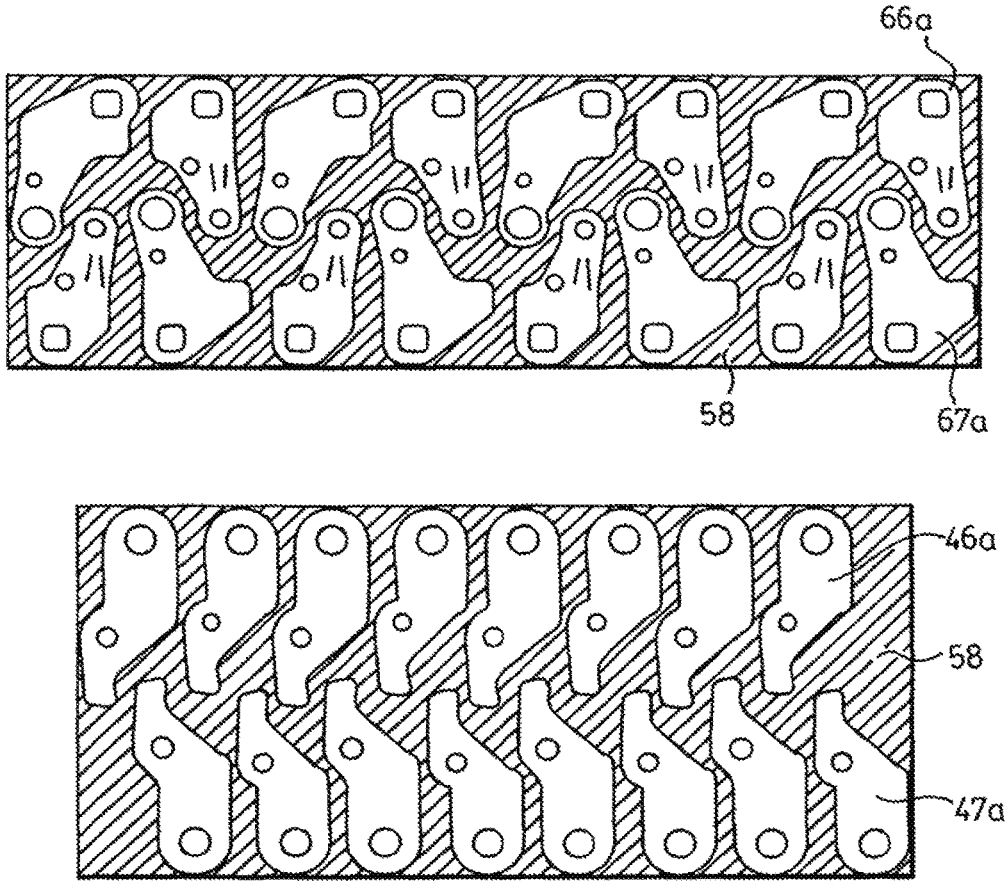
FIG. 10 is a plan view of a developed flat blank layout associated with the press form stamping of the components of the inventive hinge assembly.

FIG. 10 illustrates the flat blank layout of both the press formed body angle brackets (66*a*)(67*a*) and the press formed door angle brackets (46*a*)(47*a*) of the present invention as well as the scrap material (58) associated with the stamping process. In comparison with the flat blank layout of the prior art hinge assembly illustrated in FIG. 2 it is evident that the present invention offers superior overall material efficiency and lower scrap content than the prior art configuration.

In a preferred embodiment of the present invention a pair of hinge stop formations (70) are provided on the pivot arms (62) of the body angle brackets (66)(67) that are adapted to interact with a pair of hinge stop surfaces (50) provided on the pivot arms (42) or the door angle brackets (46)(47). When the door hinge assembly (30) is rotated to its full open position the hinge stop surfaces (50) contact the hinge stop formations (70) and prevent further rotation.

Figure 11:
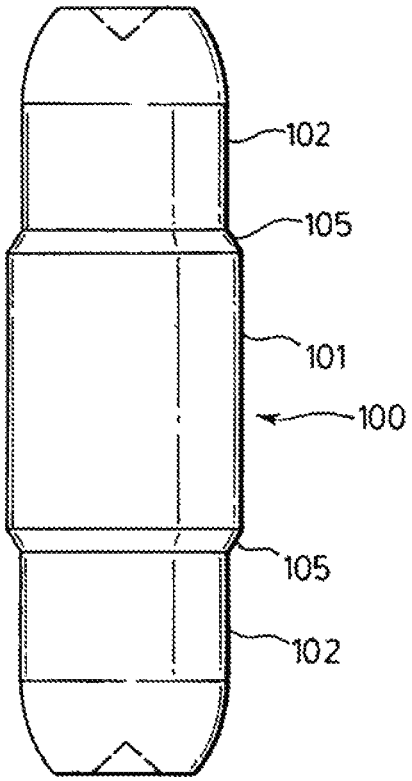
FIG. 11 is a side view of an alternative tapered step embodiment of the pivot pin of the inventive hinge assembly.

FIG. 11 illustrates an alternative embodiment of the pivot pin (100) of the present invention that incorporates two opposing cylindrical ends (102) that are configured without knurling. The pivot pin (100) is configured with tapered steps (105) between the larger diameter of the central cylindrical pivot surface (101) and the smaller diameters of two opposing cylindrical ends (102) that allow compensation for a range of body angle bracket material thickness. In the primary embodiment of the present invention the steps are configured to be square and without taper so that the door angle brackets (46)(47) are pressed on to the two knurled opposing cylindrical ends (92) to a fixed distance defined by the steps. Due to the material tolerances associated with the thickness of the two body angle brackets (66)(67) the two opposing thrust flanges (82) of the pivot bushing (80) can be under or over compressed resulting in inadequate structural assembly or poor relative rotational movement. The tapered steps (105) of the alternative embodiment allow the door angle brackets (46)(47) to be pressed onto the taper to a range of distances while allowing the riveting, staking or similar means of material upsetting to occur against a resistive base. The material interference between the two door angle brackets (46)(47) and the tapered steps (105) creates the structural connection between these components. Increased press loading allows the two door angle brackets (46)(47) to be set to a distance that properly compresses the two opposing thrust flanges (82) of the pivot bushing (80) so that adequate structural assembly and correct rotational movement can be achieved.

Figure 12:
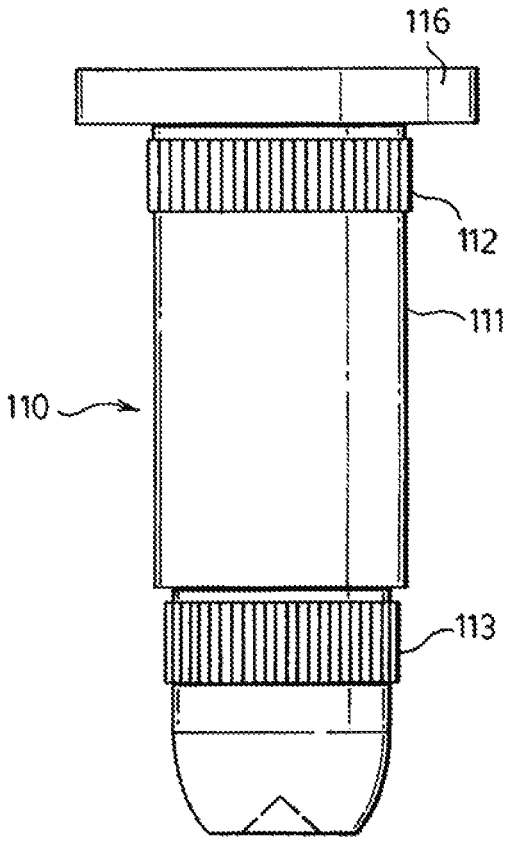
FIG. 12 is a side view of an alternative fixed head embodiment of the pivot pin of the inventive hinge assembly.

FIG. 12 illustrates an alternative embodiment of the pivot pin (110) of the present invention that is configured with a fixed head (116) to facilitate single sided riveting. The pivot pin (110) is configured with a central cylindrical pivot surface (111) and two knurled opposing cylindrical ends (112)(113). The knurled cylindrical end (112) adjacent to the fixed head (116) is of a larger diameter than the central cylindrical pivot surface (111) and the knurled cylindrical end (113) at the opposing end of the pivot pin (110) is of a smaller diameter than the central cylindrical pivot surface diameter. The fixed head (116) is of a larger diameter than the knurled cylindrical ends (112)(113) and the central cylindrical pivot surface (111). In this way the assembly process of the automotive hinge assembly (30) is simplified to a single pivot pin (110) insertion and riveting, staking or similar means of material upsetting of one end. A slight degradation of the structural attachment of the two door angle brackets (46)(47) may occur using this configuration.

Figure 13:
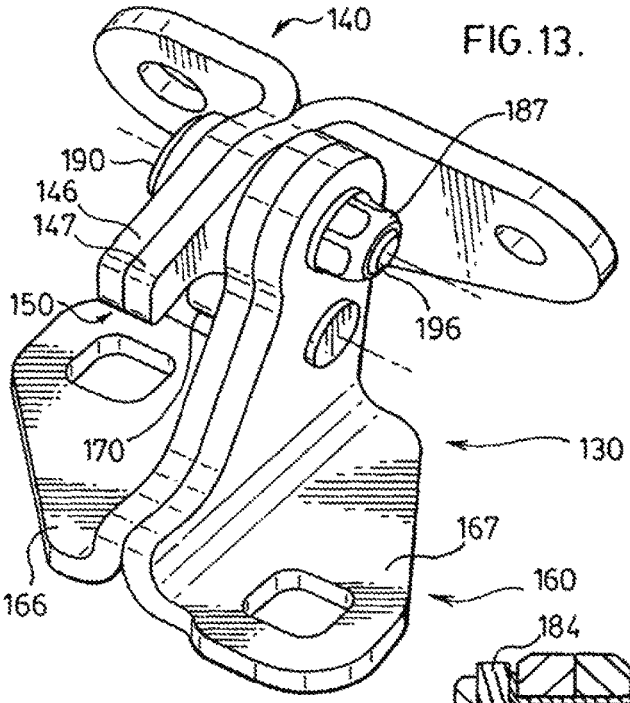
FIG. 13 is a perspective view of an alternative lift-off embodiment of the inventive hinge assembly.
Figure 14:
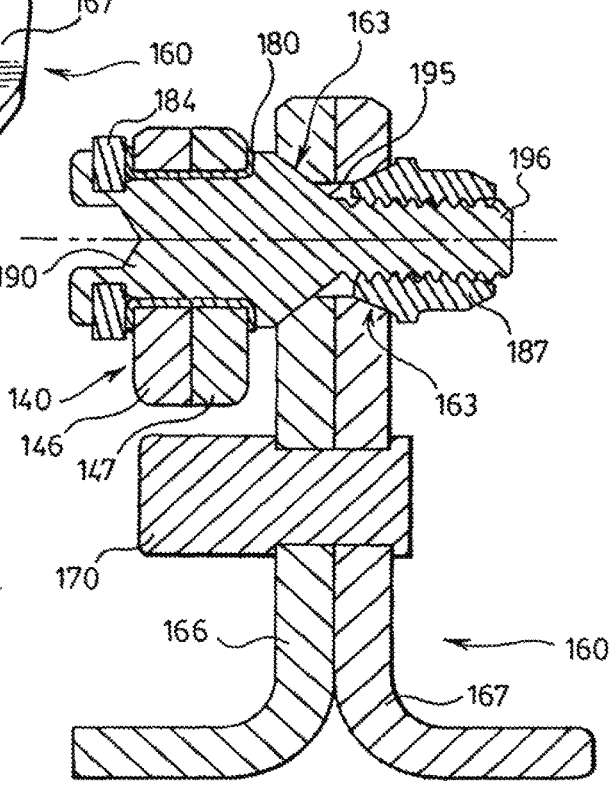
FIG. 14 is a partial sectional view of an alternative lift-off embodiment of the inventive hinge assembly through the centreline of the pivot pin.

FIGS. 13 and 14 illustrate an alternative embodiment of the present invention in that the pivot pin (190) is configured to facilitate ease of separation of the door component (140) and body component (160). This type of separation and reassembly is required in some vehicle assembly plants and is generally referred to as a lift-off process. Both the door component (140) and body component (160) are constructed in the same manner as the main embodiment of the present invention using two press formed door angle brackets (146)(147) and two press formed body angle brackets (166)(167).

However, the pivot pin (190) is configured to be structurally connected to the two door angle brackets (146)(147) through a pivot bushing (180) and washer (184) via riveting, staking or similar means of material upsetting. The end of the pivot pin (190) opposite the washer and material upset is configured with a tapered feature (195) and threaded end (196) adapted to interface with a mating cylindrical pivot axis hole (163) in the body angle brackets (166). When the door component (140) is interleaved over the body component (160) a tapered nut (187) is provided that threads onto the threaded end (196) and interfaces with the mating cylindrical pivot axis hole (163) in the body angle bracket (167) achieving correct structural assembly between the door component (140) and body component (160) while the bushing arrangement assures adequate rotational movement. A stop rivet (170) is adapted to structurally connect the two body angle brackets (166)(167) while also interacting with a hinge stop surface (150) provided on the door angle brackets (146)(147) so that when the door hinge assembly (130) is rotated to its full open position the hinge stop surfaces (150) contact the hinge stop formations (170) and prevent further rotation.

The invention claimed is:

1. A vehicular hinge assembly comprising:

a first component comprising first and second separate brackets, the first bracket being spaced apart from the second bracket;

a second component including a bushing aperture configured to accept a pivot bushing;

a pivot bushing;

a pivot pin that comprises a first end, a second end, and a pivot surface positioned between the first end and the second end, each of the first and second ends comprising an upset head following assembly of the hinge;

wherein the pivot surface of the pivot pin is disposed within the pivot bushing such that the second component is rotatable around the pivot surface, and the first and second ends of the pivot pin are structurally connected to the first and second brackets of the first component to hold the first and second brackets in a fixed relationship; and wherein the upset heads of the pivot pin hold the first component and the second component together while permitting them to rotate relative to one another to form an assembly to be mounted as a whole to a vehicular closure panel and a vehicular body structure.

2. The vehicular hinge assembly of claim 1, wherein each of the upset heads has a diameter greater than the diameter of each of the first end and the second end of the pivot pin.

3. The vehicular hinge assembly of claim 1, wherein the upset heads are formed by material upset comprising at least one of riveting or staking.

4. The vehicular hinge assembly of claim 1, wherein the first and second brackets of the first component have apertures for receiving the first and second ends of the pivot pin.

5. The vehicular hinge assembly of claim 1, wherein the first and second ends of the pivot pin are knurled.

6. The vehicular hinge assembly of claim 1, wherein the second component further comprises first and second separate brackets.

7. The vehicular hinge assembly of claim 6, wherein the first bracket of the second component comprises a mating feature, and the second bracket of the second component comprises a matching alignment aperture, the mating feature being engaged within the matching alignment aperture using press fitting, welding, bonding, riveting or staking.

8. The vehicular hinge assembly of claim 1, further comprising a hinge stop formation connected to, and projecting from, the second component to restrict the rotation of the first component within a predetermined angle.

9. The vehicular hinge assembly of claim 8, wherein the second component further comprises a hinge stop aperture to allow the hinge stop formation to extend through the hinge stop aperture and to be mounted onto the second component.

10. A vehicular hinge assembly comprising:

a first component comprising first and second separate brackets, the first bracket being spaced apart from the second bracket;

a second component including an aperture;

a pivot pin that comprises a first end, a second end, and a pivot surface positioned between the first end and the second end, each of the first and second ends comprising an upset head following assembly of the hinge;

wherein the pivot surface of the pivot pin is disposed within the aperture of the second component such that the second component is rotatable around the pivot surface, and the first and second ends of the pivot pin are structurally connected to the first and second brackets of the first component to prevent relative rotation between the first and second brackets; and wherein the upset heads of the pivot pin hold the first component and the second component together to form an assembly to be mounted as a whole to a vehicular closure panel and a vehicular body structure.

11. The vehicular hinge assembly of claim 10, wherein each of the first and second brackets of the first component has an aperture, and the first and second ends of the pivot pin are secured within the apertures.

12. A vehicular hinge assembly comprising:

a first component comprising first and second separate brackets, the first bracket being spaced apart from the second bracket;

a second component including a bushing aperture configured to accept a pivot bushing;

a pivot bushing;

a pivot pin that comprises a first end, a second end and a pivot surface positioned between the first end and the second end, each of the first end and second end comprising means to structurally connect the pivot pin to the first and second separate brackets of the first component respectively;

wherein the pivot surface of the pivot pin is disposed within the pivot bushing such that the second component is rotatable around the pivot surface, and the first and second ends of the pivot pin are structurally connected to the first and second separate brackets of the first component so that the first and second brackets do not rotate in relation to each other;

wherein the first component and the second component are thus held together to form an assembly to be mounted as a whole to a vehicular closure panel and a vehicular body structure.

13. The vehicular hinge assembly of claim 12, wherein the means to structurally connect the pivot pin to the first and second separate brackets includes a materially upset head on at least one of the first end and the second end of the pivot pin.

14. The vehicular hinge assembly of claim 13, wherein the materially upset head on at least one of the first end and the second end of the pivot pin is formed by material upset comprising one of riveting and staking.

15. The vehicular hinge assembly of claim 12, wherein the means to structurally connect the pivot pin to the first and second separate brackets includes materially upset heads on each of the first end and the second end of the pivot pin.

16. The vehicular hinge assembly of claim 15, wherein the materially upset heads on each of the first end and the second end of the pivot pin are formed by material upset comprising one of riveting and staking.

17. The vehicular hinge assembly of claim 12, wherein the first and second brackets of the first component have apertures for receiving the first and second ends of the pivot pin.

18. The vehicular hinge assembly of claim 12, wherein the pivot pin is knurled adjacent each of the first and second ends.

19. The vehicular hinge assembly of claim 12, wherein the second component further comprises first and second separate second component brackets.

20. The vehicle hinge assembly of claim 1, wherein the second component comprises first and second body brackets.

21. The vehicle hinge assembly of claim 1, wherein the second component comprises first and second door brackets.

* * * * *